United States Patent [19]

Larsen

[11] 4,296,927

[45] * Oct. 27, 1981

[54] GAME BOARD AND CARDS

[76] Inventor: Russell E. Larsen, 1517 E. Garfield, Apt. #71, Glendale, Calif. 91205

[ * ] Notice: The portion of the term of this patent subsequent to Jul. 8, 1997, has been disclaimed.

[21] Appl. No.: 956,022

[22] Filed: Oct. 30, 1978

[51] Int. Cl.[3] ..... A63F 3/00

[52] U.S. Cl. ..... 273/248

[58] Field of Search ..... 273/243, 248

[56] References Cited

U.S. PATENT DOCUMENTS

| | | | |
|---|---|---|---|
| 1,615,927 | 2/1927 | Atkinson | 273/248 |
| 2,232,055 | 2/1941 | Davis | 273/243 |
| 2,611,616 | 9/1952 | Kloss | 273/243 |
| 3,445,115 | 5/1969 | Hunter | 273/243 |
| 4,119,321 | 10/1978 | Creel | 273/248 |
| 4,123,062 | 10/1978 | Wexler et al. | 273/243 |
| 4,211,419 | 7/1980 | Larsen | 273/248 |

*Primary Examiner*—Richard C. Pinkham
*Assistant Examiner*—Scott L. Brown
*Attorney, Agent, or Firm*—Thorpe, North, Western & Gold

[57] ABSTRACT

Game cards for use with a game board which has separate movement zones for each player, each zone having multiple confined locations for movement of markers therein. The game cards have movement instructions consisting of two symbols representing separate but concurrent move options for a player using the card. Card symbols are also used to identify which of the various movement zones may be played by the particular player, thereby permitting players to exercise move options based on strategy and marker positioning. Several distinguishable classes of symbols are used on a single card to provide options based on different combinations of such symbols.

8 Claims, 3 Drawing Figures

GAME BOARD AND CARDS

This invention pertains to game cards and more particularly, to game cards for use with game boards having markers which are moved in accordance with game card instructions.

OBJECTS AND SUMMARY OF THE INVENTION

It is an object of the present invention to provide game cards having movement options for markers positioned on a game board.

It is a further object of this invention to provide game cards which are coordinated with a game board to define movement instructions in segregated movement zones on each side of such a game board.

It is a further object of this invention to provide a means for selecting symbols for use on the game cards which will develop opportunities for strategy and planning between opposing players.

It is yet another object to provide gaming cards in combination with a game board which are coordinated to develop a single, unified game and procedure having multiple move options for a single card.

These and other objects of the present invention are realized in a game apparatus which includes a game board having a plurality of separate movement zones for each player, each zone having multiple locations for movement of markers positioned therein and a plurality of cards defining appropriate movement instructions. Each card has at least two symbols representing separate but concurrent move options for the player having possession of the card. Each of the separate symbols identifies movement to be effected in one of the separate movement zones contained on the game board. Movement within each separate movement zone is thereby coordinated with selection and use of the particular gaming cards having identity relationship with the specific movement zone. Among the methods utilized to provide concurrent move options, is the use of separate and distinguishable symbols on a single card, the various combinations of such symbols providing two or more options for movement of markers on the game board. Specific apparatus of play are also provided herein.

Other objects and features of the present invention will be obvious to a person skilled in the art from the following detailed description, taken with the accompanying drawings, described as follows.

DETAILED DESCRIPTION OF THE INVENTION

Figure 1:
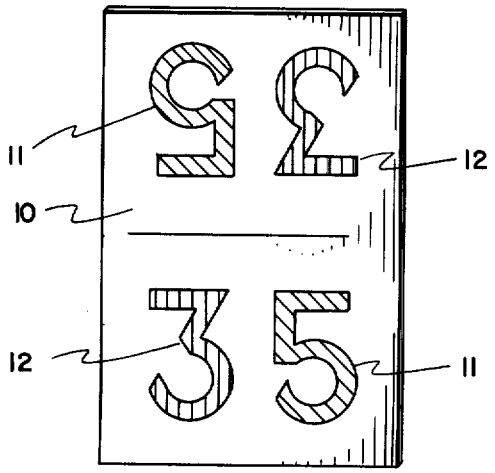
FIG. 1 shows a game card having symbols in accordance with the subject invention.

Referring now to the Drawings:

As one example of a game card of the present invention, FIG. 1 shows a card 10 having symbols 11 and 12 depicted thereon. Although the illustrated symbols consist of numerals 3 and 5, it is to be understood that any form of symbol may be utilized. For example, pictures of animals or objects may be appropriate for children applications of the subject game. Other forms of symbols can be selected which have relation to the game board to be used in combination with the game card.

Figure 2:
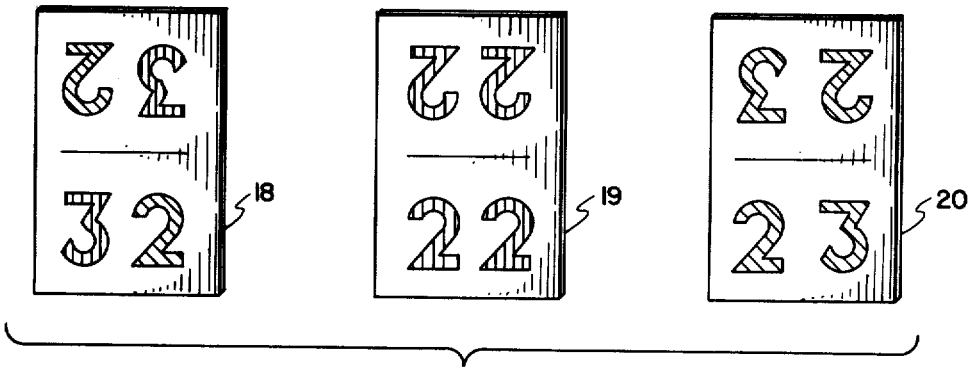
FIG. 2 shows part of a set of coordinated game cards having distinguishable symbols.
Figure 3:
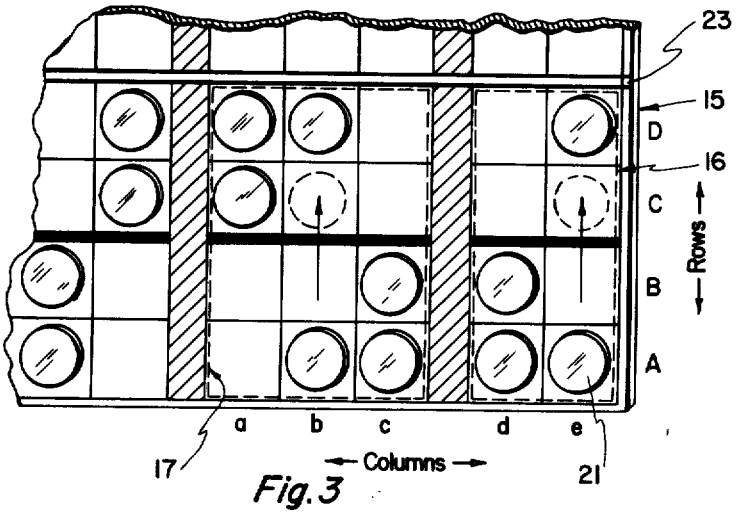
FIG. 3 shows a section of a game board having separate movement zones with markers positioned therein.

FIG. 3 illustrates one type of game board 15 which is particularly adapted for use with the game cards illustrated in FIGS. 1 and 2. In FIG. 2, for example, the symbol 2 shown on each of the three cards 18, 19 and 20 is coordinated with a section 16 of the game board 15, having reference to the two columns contained in section 16. Likewise, the number 3 in the respective cards 18, 19 and 20 of FIG. 2 is coordinated with the three column section 17. The two sections 16 and 17 are defined herein as separate movement zones and contain markers 21 for movement along the column length in accordance with instructions contained on the game cards.

In one embodiment of the specific invention the coordination between the numbers shown on the game cards 18, 19 and 20 identify the specific movement zone 16 or 17 where marker movement is permitted. The specific movement instructions defined by the game cards will depend upon the game objectives and board design. In each case, however, the card will contain move options which give the player a choice in marker movement, either between markers within the same movement zone as in card 19 of FIG. 2, or in markers for differing movement zones, as in cards 18 and 20. A player selecting card 20 might therefore have the options to move a marker forward along the columns of section 16 and also a marker forward along the columns within section 17, based upon the respective symbols 2 and 3 contained on the card.

As indicated earlier, the selected symbols may be of numerous types. As an alternative to the numerals utilized in the figures which are based on the number of columns in each of the separate movement zones, symbols could be objects related to unique pictures contained in each respective movement zone. For example, the respective movement zones of a child's game may comprise pictures of different rooms of a house or of separate and unique sectors of a farm, with the symbols used on the game cards being objects within the respective rooms or animals associated with the respective sectors of the house and farm pictures respectively. Obviously, enumerable combinations of related card symbols and separate movement zones are conceivable. For the sake of simplicity, the disclosure herein will relate to numerals as represented in the figures. Such action should not, therefore, be considered as limiting the scope of the invention in any manner.

In providing a general description of the method to be followed in developing a set of game cards appropriate to a given game board, the following steps are outlined.

Step 1: A game board is selected or designed which has multiple separate movement zones for each respective player. Markers will be positioned within each of the respective movement zones for limited movement therein;

Step 2: A set of symbols is identified, each symbol having reference to a specific movement zone on the playing board;

Step 3: Playing cards are prepared which have at least two of the identified symbols on each respective card. These symbols will each permit movement of markers within the corresponding movement zone, the player having the option of moving the number of markers corresponding the number of symbols placed on the playing card; and Step 4: Providing instructions to the players including directions for random selection of one or more of the playing cards whose symbols will provide movement options for the player.

Additional modifications of the basic game cards and method will illustrate its capacity for adaption to various age groups and to various levels of skill and strategy. For example, a bonus move can be implemented using cards as shown in FIG. 2. An exemplary method of implementing such a bonus move is to designate that when markers 21 are moved into a final position along the columns (a, b, c, d and e) of the game board (FIG. 3), a bonus move may be awarded. Therefore, if a player were to draw card 18 showing the red and green symbols "32", move options would be available to move a marker in the two column section 16 or in the three column section 17. If the marker located in the grid position designated eA were moved forward to the grid position eC, the pieces of column e would now be in a finished position at a forward location of the column, assuming the illustrated rearward location of markers in column d to be the start position.

An additional method of bonus play would be to utilize cards having a plurality of symbols which are distinct in character. In FIG. 1, for example, the "3" symbol 12 is distinguishable from the "5" symbol 11 by virtue of color difference. Obviously, distinguishing features or styling could also be used to provide distinctness between sets of symbols. Bonus moves could be developed for a particular set of symbols, such as the red numerals of FIG. 2. In this case, whenever a player were to draw a card having a red symbol, the bonus turn explained previously might be available. In other words, a player having drawn card 19 would have the option of moving a marker in columns d or e because of the correlation between the number "2" on the card and the separate movement zone designation of two columns. If the player were to move the rearward marker of column e to a forward, finish position in row C, a bonus turn would be awarded since the player would have completed play in that column. It will be apparent that enumerable combinations of symbols and move procedures could be implemented to incorporate comparable bonus turn options. The value of such an option would arise in play between two parties, where the object of the game was to secure as many columns for one player's side as possible before the ending of the game.

To more fully illustrate the function of card symbols in connection with a game board having a required separate movement zone, the following specific illustration is provided. An exemplary set of cards would include the numerical symbols 2, 3, 5, 3 and 2, corresponding to separate movement zones on each player's side of the game board. Each of these sides would have zones consisting of 2, 3, 5, 3 and 2 columns respectively, as illustrated in FIG. 3. The cards of this game will have two numerals on each card, representing each possible two-number combination of the numbers 2, 3 and 5. A first group of numbers will be depicted in substantially similar character and appearance in the form of red numbers 22, 33 and 55 (see 19, FIG. 2). A preferred number of cards of this series would be 4, 6 and 5, respectively, for a total of 15 cards of this first group of red numbers.

A second set of cards will be included in the deck of cards using the number pairs 53, 52 and 32. With respect to this group of numbers, the first number would be shown in red appearance and the second in green as illustrated in FIG. 2 on card 18. Five cards for each of the three number pairs are included in the deck to constitute an additional 15 card total. A third and last set of number pairs comprises 23, 25, and 35. Both the first and second numbers of these number pairs are shown in the same character and appearance (green color) and are thereby distinguished from the previous two groups of numbered cards. Five cards of each of the respective three number pairs provides an additional 15 cards, bringing the total cards of the deck to 45, consisting of nine different cards. It is now apparent that the two classes of distinguishable symbols are numbers in red and numbers in green.

Using the referenced set of 45 cards, a bonus move option is developed by providing that selection of a card having a red number giving rise to the bonus move option. Selection of a card having only green numbers would give no bonus move option. Assuming the bonus move would be awarded only upon movement of two markers forward to complete a finish position in each of the respective columns (see column b and column e of FIG. 3), the move options using the three cards illustrated in FIG. 2 would be as follows:

Card 18: Markers in columns b and c, and d and e can be moved forward in view of the corresponding numerals "3" and "2" on the card. A bonus turn can be obtained by moving the rearward markers of columns b and e to the forward finish positions, in view of the occurrence of a red symbol on the card. It will be noted that movement of markers in response to this second set of number pairs (53, 52 and 32) will always be split in different movement zones.

Card 19: Markers may be moved forward in columns d or e in view of the corresponding pair of numerals of the "two" category. An extra turn may be obtained with these moves provided the player does not use both moves to complete a single column as in "d".

Card 20: This card provides the same move options as card 18 with respect to tokens in columns a through e; however, no extra turn would be awarded in view of the absence of the red colored numeral.

The significance of the extra turn option is apparent when the object of play is to secure both markers in the forward, finish positions of rows C and D. Increased competition and strategic planning is required when rules of play include the requirement that movement by one player into a finish position on a given column returns the opposing players markers in the opposing corresponding column to the rearward position. The effect of this play is to require constant attention of the players to the location of single markers in a forward position as in columns b and e, realizing that such markers are exposed to return to the rearward position upon advancement of the opposing players markers to a finish position.

This sequence can be more easily visualized by imagining a comparable set of markers for an opposing player situated across the double center line 23 on a playing board which would represent a mirror image of the playing board segment illustrated in FIG. 3. The strategy of play then becomes a sequence of exposing markers and protecting markers in a manner to secure the most favorable position, based on the probability of drawing a selected number combination from the unplayed cards. Usually, as cards are drawn, they are not returned to the deck in order to limit the length of the game sequence to a series of 45 drawn cards or to a completed finish position by either player along the full length of his playing board.

Although any number of cards for each of the respective groups can be determined, the applicant has found that the 15 card totals for each group of number combinations provides a favorable set of numerical probabilities for advancing markers with the bonus turn option indicated. Modification of the game board to include different numbers of columns would obviously require adjustment of the numbers of cards and types of number combinations to develop a proper balance in numerical probability.

Although a preferred form of the invention has been herein described, it is to be understood that this disclosure is by way of example and the variations, in addition to those suggested, are possible without departing from the scope of the hereinafter claimed subject matter, which subject matter is to be regarded as the invention.

I claim:

1. A game apparatus including:

(a) a game board with a pluarlity of separate movement zones for each player, each zone having multiple locations for movement of markers positioned therein;

(b) markers for placement in each respective zone; and (c) a plurality of cards defining movement instructions, each card having at least two symbols representing separate but concurrent move options for a player having possession of said card, each of said symbols having corresponding identity relationship with a specific movement zone based on total numbers of columns representing directions of movement within the given movement zone to limit marker movement within said zone.

2. A game apparatus as defined in claim 1, wherein said symbols comprise numerals selected from a range of numbers from 0 to 9, each number being coordinated with a number value assigned to a given movement zone.

3. A game apparatus as defined in claim 2, wherein one of the selected numerals for an instruction card is distinguishable in appearance from each other numeral on the card.

4. A game apparatus as defined in claim 3, wherein the distinguishable appearance of numerals arises by difference in style or color.

5. A game apparatus as defined in claim 2, wherein the game board comprises movement zones with assigned numerical values of 2, 3, 5, 3 and 2 respectively for each player, said selected numerals for the instruction cards being selected from the numbers 2, 3 and 5.

6. A game apparatus as defined in claim 5, wherein two numerals are placed on each card and represent each possible two-number combination of the numbers 2, 3 and 5.

7. A game apparatus as defined in claim 6, wherein the two-number combinations comprise three categories as follows:

(a) a first group of 22, 33 and 55—the numbers of said first group being depicted in substantially similar character and appearance;

(b) a second group of 53, 52 and 32—the first number of each pair of numbers of said second group being distinguishable from the second number in each pair, with the respective first numbers being substantially similar in character and appearance with the numbers of said first group and the respective second numbers being substantially similar in character and appearance; and (c) a third group of 23, 25, and 35—the numbers of said third group being depicted in substantially similar character and appearance with the second numbers of said second group.

8. A game apparatus as defined in claim 7, wherein a total of five cards occurs for each number pair represented in said third group comprising 23, 25 and 35, and in said second group comprising 53, 52 and 32, and a total of 4, 5 and 6 cards occurring for the respective number pairs 22, 55 and 33 of the first group.

* * * * *